US007500455B2

(12) United States Patent
Kusano et al.

(10) Patent No.: US 7,500,455 B2
(45) Date of Patent: Mar. 10, 2009

(54) VALVE TIMING CONTROL APPARATUS

(75) Inventors: Shigeyuki Kusano, Okazaki (JP); Akira Shimadu, Toyota (JP); Eiji Isobe, Kariya (JP); Takayuki Inohara, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 179 days.

(21) Appl. No.: 11/723,382

(22) Filed: Mar. 19, 2007

(65) Prior Publication Data

US 2007/0215103 A1 Sep. 20, 2007

(30) Foreign Application Priority Data

Mar. 20, 2006 (JP) ..... 2006-076223

(51) Int. Cl.
*F01L 1/34* (2006.01)

(52) U.S. Cl. ..... 123/90.17; 123/90.15; 123/90.31; 464/160

(58) Field of Classification Search ... 123/90.15–90.17, 123/90.31; 464/160
See application file for complete search history.

(56) References Cited

U.S. PATENT DOCUMENTS 6,883,482 B2 4/2005 Takenaka et al.
2007/0251478 A1 * 11/2007 Ido et al. ..... 123/90.17

* cited by examiner

*Primary Examiner*—Ramon M Barrera
(74) *Attorney, Agent, or Firm*—Nixon & Vanderhye PC

(57) ABSTRACT

In a guide groove of a guide rotator of a valve timing control apparatus, a stopper surface is planar and is positioned in an end of the guide groove. The stopper surface is engageable with a cylindrical outer peripheral surface of a movable body, which is received in the guide groove, to stop the movable body. An arcuate outer connection surface connects between the stopper surface and an outer guide surface and has a radius of curvature, which is smaller than that of the cylindrical outer peripheral surface of the movable body. An arcuate inner connection surface connects between the stopper surface and an inner guide surface and has a radius of curvature, which is smaller than that of the cylindrical outer peripheral surface of the movable body.

4 Claims, 8 Drawing Sheets

VALVE TIMING CONTROL APPARATUS

CROSS REFERENCE TO RELATED APPLICATION

This application is based on and incorporates herein by reference Japanese Patent Application No. 2006-76223 filed on Mar. 20, 2006.

BACKGROUND OF THE INVENTION

1. Field of the Invention

The present invention relates to a valve timing control apparatus of an internal combustion engine.

2. Description of Related Art

A known valve timing control apparatus includes a first rotator and a second rotator, which are rotated synchronously with a crankshaft and a camshaft, respectively, of an internal combustion engine. In this valve timing control apparatus, a relative rotational phase between the first rotator and the second rotator is changed by a link mechanism to adjust valve timing. For instance, in a case of such an apparatus recited in Japanese Unexamined Patent Publication No. 2005-48707 (corresponding to U.S. Pat. No. 6,883,482), a movable body, which is fitted into a guide groove of a guide rotator, is coupled with the link mechanism. In response to rotation of the guide rotator, the movable body is moved, so that the relative rotational phase between the first rotator and the second rotator is changed.

In the apparatus recited in Japanese Unexamined Patent Publication No. 2005-48707, when the relative rotational phase of the second rotator on the camshaft side relative the first rotator on the crankshaft side reaches a predetermined phase, the second rotator abuts against a stopper of the first rotator and is thereby stopped. When the second rotator is stopped, a change in the relative rotational phase of the second rotator relative to the first rotator is limited. Thus, it is possible to set a most advanced phase or a most retarded phase in terms of the relative rotational phase.

However, in the apparatus recited in Japanese Unexamined Patent Publication No. 2005-48707, when the second rotator abuts against the stopper of the first rotator, an impact force is generated. This impact force is transmitted from the first rotator and the second rotator to the movable body through the link mechanism. At that time, due to a clearance formed at a connection of each link of the link mechanism as well as a clearance between the movable body and the guide groove, each link and/or the movable body may possibly be tilted. Particularly, when the movable body is tilted, the movable body may possibly stick to the guide groove, i.e., may possibly be arrested by the guide groove. When this happens, a malfunction, such as a mechanical lock, may disadvantageously occur. Thus, it is important to limit the tilting of the movable body.

SUMMARY OF THE INVENTION

The present invention addresses the above disadvantage. Thus, it is an objective of the present invention to provide a valve timing control apparatus, which more effectively limit a malfunction or a damage thereof.

To achieve the objective of the present invention, there is provided a valve timing control apparatus of an internal combustion engine, which controls valve timing of at least one of an intake valve and an exhaust valve that are opened and closed by a camshaft driven by a torque transmitted from a crankshaft. The valve timing control apparatus includes a first rotator, a second rotator, a guide rotator, a movable body and a link mechanism. The first rotator is rotated synchronously with the crankshaft. The second rotator is rotated synchronously with the camshaft. The guide rotator has a guide groove, which is elongated and has a predetermined width. The movable body is guided in the guide groove in a direction of elongation of the guide groove to move toward or away from a rotational axis of the guide rotator in response to rotation of the guide rotator. The link mechanism is coupled with the first rotator, the second rotator and the movable body to change a relative rotational phase between the first rotator and the second rotator in response to movement of the movable body. The movable body has a cylindrical outer peripheral surface. The guide groove includes a stopper surface, an outer guide surface, an arcuate outer connection surface, an inner guide surface and an arcuate inner connection surface. The stopper surface is planar and is positioned in one of two opposed ends of the guide groove, which are opposed to each other in the direction of elongation of the guide groove. The stopper surface is engageable with the cylindrical outer peripheral surface of the movable body in the direction of elongation of the guide groove to stop the movable body. The outer guide surface is slidably engageable with the cylindrical outer peripheral surface of the movable body to guide the movable body and that is positioned on a radially outer side of the movable body in a radial direction of the guide rotator. The arcuate outer connection surface connects between the stopper surface and the outer guide surface and has a radius of curvature, which is smaller than that of the cylindrical outer peripheral surface of the movable body. The inner guide surface is slidably engageable with the cylindrical outer peripheral surface of the movable body to guide the movable body and that is positioned on a radially inner side of the movable body in the radial direction of the guide rotator. The arcuate inner connection surface connects between the stopper surface and the inner guide surface and has a radius of curvature, which is smaller than that of the cylindrical outer peripheral surface of the movable body.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to FIGS. 1 to 8.

Figure 2:
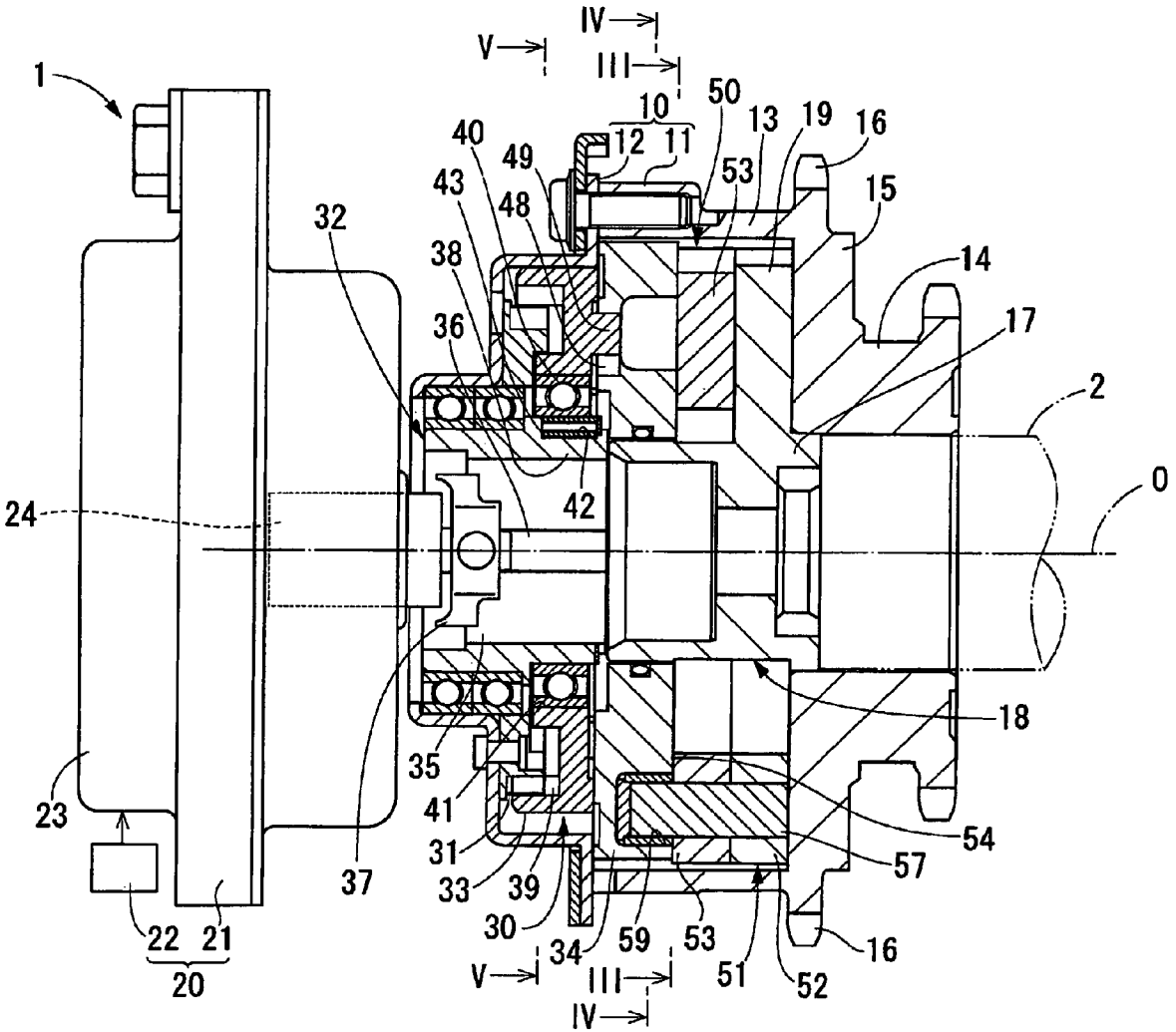
FIG. 2 is a cross sectional view taken along line II-II in FIG. 3 schematically showing the valve timing control apparatus of the embodiment.

FIG. 2 shows a valve timing control apparatus 1 according to an embodiment of the present invention. The valve timing control apparatus 1 is provided in a transmission system, which transmits the engine torque from the crankshaft of the internal combustion engine to a camshaft 2. The valve timing control apparatus 1 controls, i.e., adjusts valve timing of an intake valve(s) of the internal combustion engine by changing a relative rotational phase between the crankshaft and the camshaft 2.

The valve timing control apparatus 1 includes a driving-side rotator 10, a driven-side rotator 18, a control unit 20, a differential gear mechanism 30 and a phase change mechanism 50.

Figure 3:
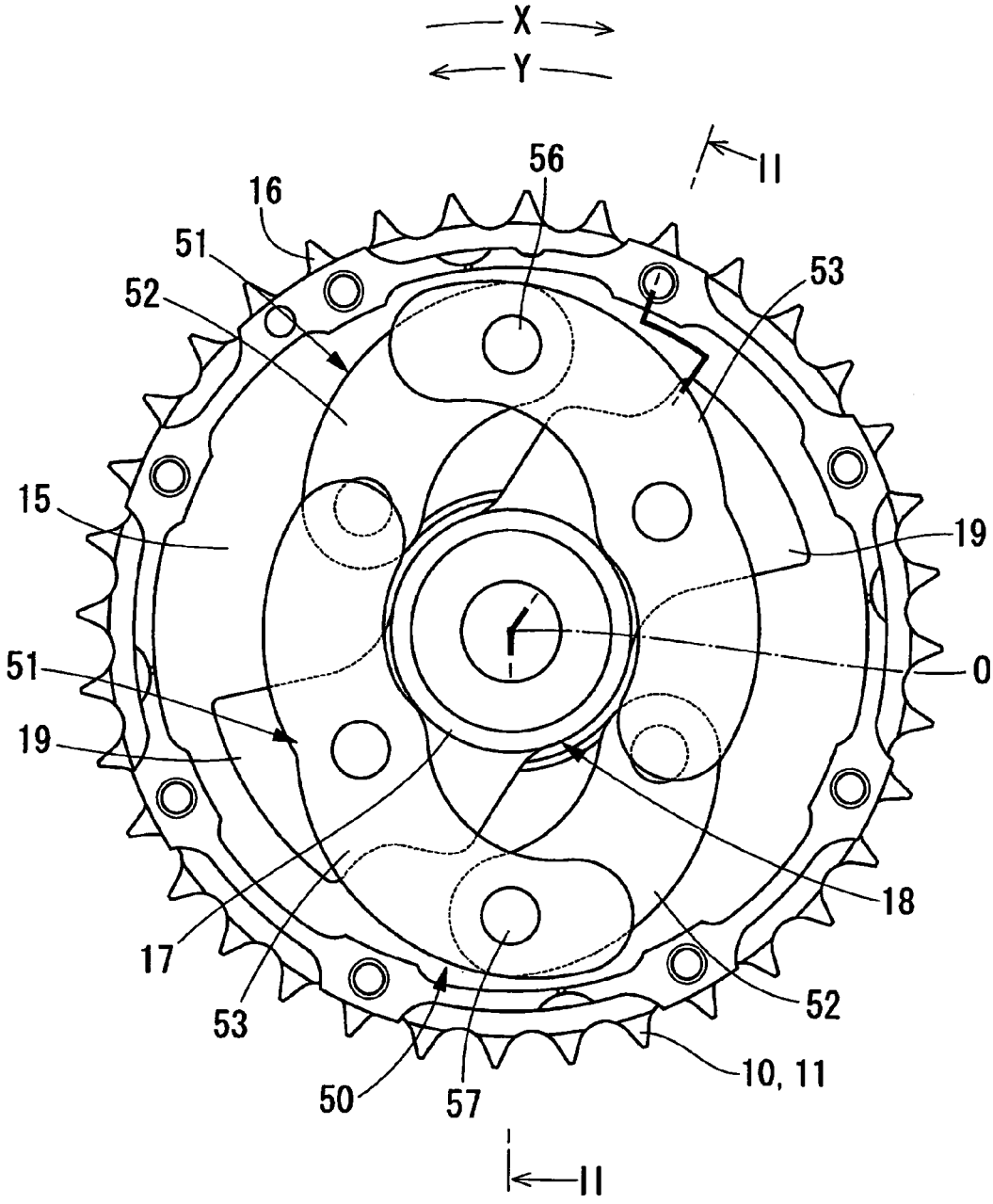
FIG. 3 is a cross sectional view taken along line III-III in FIG. 2.
Figure 4:
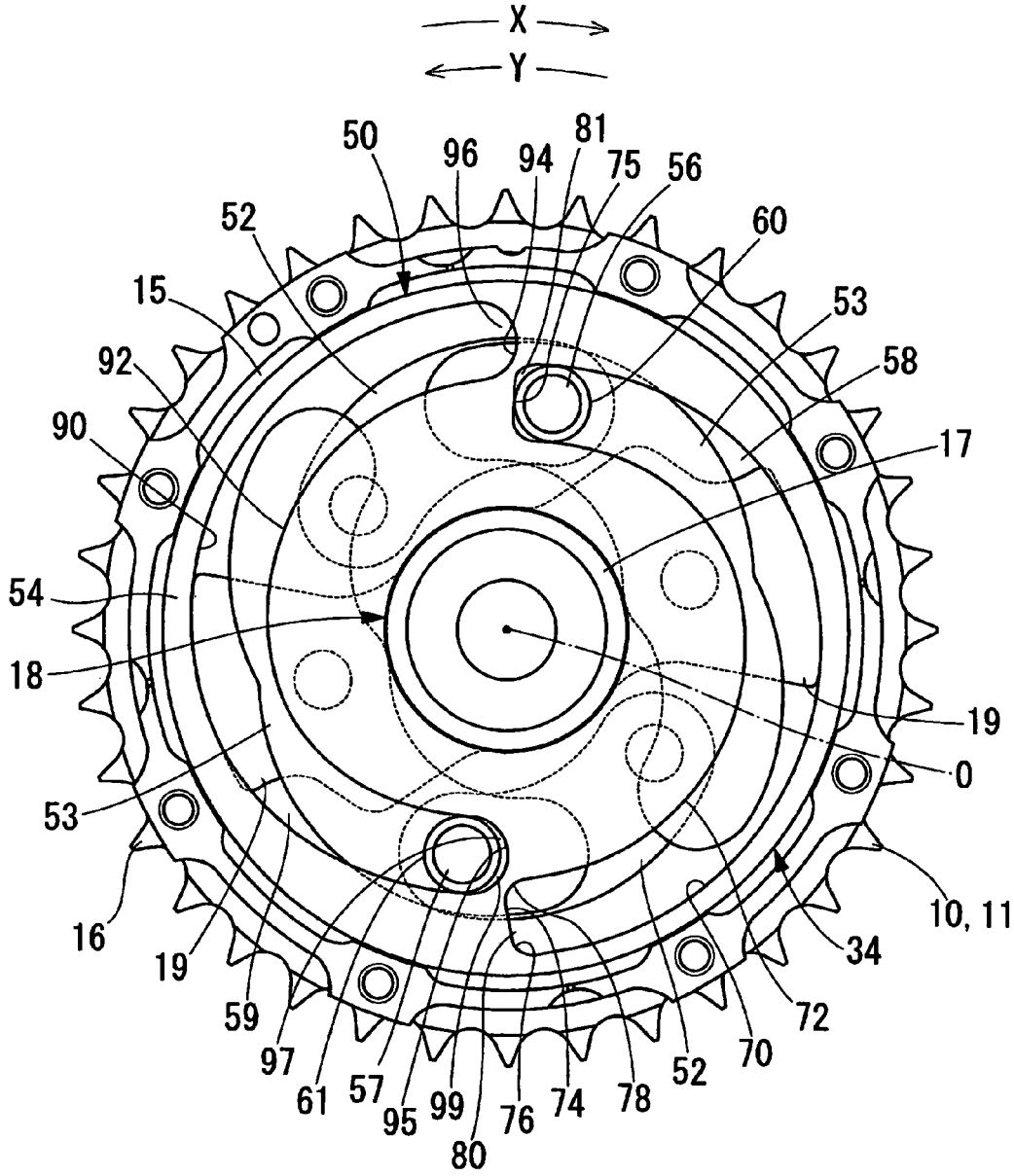
FIG. 4 is a cross sectional view taken along line IV-IV in FIG. 2.

As shown, in FIGS. 2 to 4, the driving-side rotator 10 is formed as a hollow body to receive the differential gear mechanism 30 and the phase change mechanism 50. The driving-side rotator 10 includes a double stepped sprocket 11 and a double stepped cylindrical cover 12. A large diameter side end portion of the cover 12 is coaxially fixed to a large diameter side end portion of the sprocket 11 with screws. In the sprocket 11, a connecting portion 15, which connects between a large diameter portion 13 and a small diameter portion 14, has a plurality of teeth 16, which protrude radially outward. A timing chain is placed around the teeth 16 of the sprocket 11 and a plurality of teeth of the crankshaft. When the engine torque, which is outputted from the crankshaft, is transmitted to the sprocket 11 through the timing chain, the driving-side rotator 10 is synchronized with the crankshaft, so that the driving-side rotator 10 is rotated about a rotational axis O while maintaining the relative rotational phase of the driving-side rotator 10 relative to the crankshaft. At this time, the rotational direction of the driving-side rotator 10 is a clockwise direction in FIGS. 3 and 4.

As shown in FIGS. 2 and 3, the driven-side rotator 18 includes a shaft 17 and two coupling portions 19. The shaft 17 is formed into a cylindrical body and is arranged coaxially with respect to the driving-side rotator 10 and the camshaft 2. One end portion of the shaft 17 is slidably received in the connecting portion 15 of the sprocket 11 and is fixed to one end of the camshaft 2 with bolts. In this way, the driven-side rotator 18 is rotated synchronously with the camshaft 2 about the rotational axis O while maintaining the relative rotational phase of the driven-side rotator 18 relative to the camshaft 2. Also, the driven-side rotator 18 is rotatable relative to the driving-side rotator 10. One relative rotational direction of the drive-side rotator 18, which causes advance movement of the driven-side rotator 18, is the direction X and will be also referred to as an advancing direction. The other relative rotational direction of the driven-side rotator 18, which causes retardation movement of the drive-side rotator 18, is the direction Y and will be also referred to as a retarding direction.

Each coupling portion 19 is formed as a planar plate, which radially outwardly projects from an axially intermediate part of the shaft 17. Furthermore, the coupling portions 19 are displaced from each other by 180 degrees about the rotational axis O.

As shown in FIG. 2, the control unit 20 includes an electric motor 21 and a power supply control circuit 22. The electric motor 21 is, for example, a brushless motor and includes a motor case 23 and a motor shaft 24. The motor case 23 is fixed to the internal combustion engine through a stay (not shown). The motor shaft 24 is supported by the motor case 23 in a rotatable manner in both of a normal rotational direction and a reverse rotational direction. The power supply control circuit 22 is an electric circuit (e.g., a microcomputer) and is placed inside or outside of the motor case 23. The power supply control circuit 22 is electrically connected to the electric motor 21. The power supply control circuit 22 controls supply of the electric current to a coil (not shown) of the electric motor 21 based on an operational state of the internal combustion engine. Through this power supply control operation, the electric motor 21 forms a rotating magnetic filed around the motor shaft 24 to exert the rotational torque to the motor shaft 24 in the direction X or Y (see FIG. 5) in consistent with a direction of the rotating magnetic field.

Figure 5:
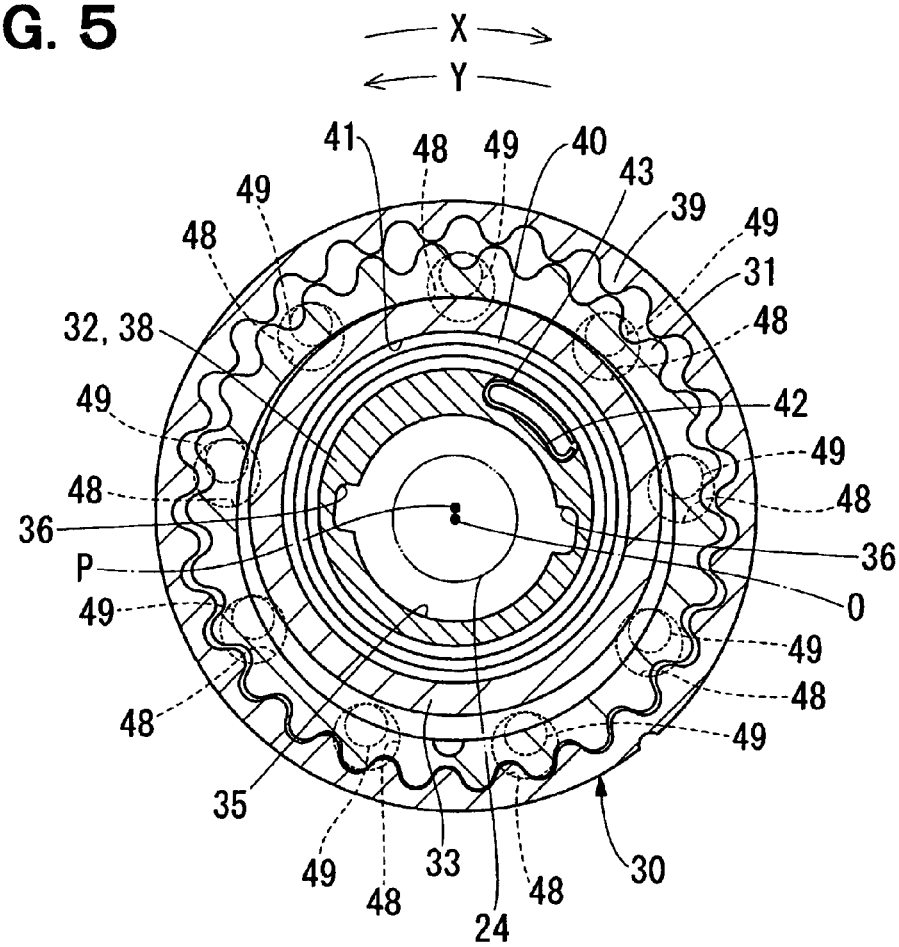
FIG. 5 is a cross sectional view taken along line V-V in FIG. 2.

As shown in FIGS. 2 and 5, the differential gear mechanism 30 includes an external gear 31, a planetary carrier 32, an internal gear 33 and a guide rotator 34.

The external gear 31, which has an addendum circle placed radially outward of the dedendum circle, is riveted to the cover 12 in a coaxial manner and is integrally rotatable with the driving-side rotator 10.

The planetary carrier 32 is formed into a cylindrical body and includes an inner peripheral surface 35, which is a cylindrical surface that is coaxial with the rotational axis of the driving-side rotator 10. A groove 36 is opened in an inner peripheral surface 35 of the planetary carrier 32. The motor shaft 24 is fixed to the planetary carrier 32 in a coaxial manner with respect to the inner peripheral surface 35 of the planetary carrier 32 through a coupling 37. Through this fixation, the planetary carrier 32 is rotatable synchronously with the motor shaft 24 about the rotational axis O. Furthermore, the planetary carrier 32 is rotatable relative to the driving-side rotator 10. An eccentric cam 38 of the planetary carrier 32, which is positioned on a side opposite from the motor shaft 24, has a cylindrical outer peripheral surface, which is eccentric to the driving-side rotator 10.

The internal gear 33 is formed into a bottomed cylindrical body and includes a toothed portion 39, in which an addendum circle is placed radially inward of a dedendum circle of the toothed portion 39. The dedendum circle of the toothed portion 39 is larger than the addendum circle of the external gear 31. Also, the number of teeth of the toothed portion 39 is greater than the number of teeth of the external gear 31 such that a difference between the number of teeth of the toothed portion 39 and the number of teeth of the external gear 31 is one. The toothed portion 39 is eccentric to the rotational axis O, that is, the rotational axis of the toothed portion 39 is radially outwardly displaced from the rotational axis O in the radial direction of the external gear 31. A central hole 41 of the internal gear 33 is formed into a cylindrical hole, which is coaxial with the toothed portion 39. The eccentric cam 38 is fitted to the central hole 41 of the internal gear 33 through a bearing 40. In this way, the internal gear 33 is supported by the planetary carrier 32 in such a manner that the internal gear 33 rotates about an eccentric axis P of the outer peripheral surface of the eccentric cam 38 and at the same time evolves in the rotational direction of the eccentric cam 38 to implement the planetary movement. In the present embodiment, a U-shaped leaf spring 43 is received in a receiving hole 42, which is opened in an outer peripheral surface of the eccentric cam 38. When the leaf spring 43 pushes an inner peripheral surface of the central hole 41 of the internal gear 33 through the bearing 40, the internal gear 33 is effectively meshed with the external gear 31.

As shown in FIGS. 2 and 4, the guide rotator 34 is formed into an annular plate body, which is coaxial with the driving-side rotator 10. The guide rotator 34 is slidably fitted to the outer peripheral surface of an end portion of the shaft 17 of the driven-side rotator 18, which is opposite from the camshaft 2. In this way, the guide rotator 34 is supported rotatably about the rotational axis O, and thereby the guide rotator 34 is rotatable relative to the rotators 10, 18. As shown in FIGS. 2 and 5, the guide rotator 34 includes a plurality (nine in this instance) of cylindrical engaging holes 48, which are arranged one after another at equal intervals in the rotational direction. The internal gear 33 includes a corresponding plurality (nine in this instance) of cylindrical engaging projections 49, which are arranged one after another at equal intervals in the rotational direction in such a manner that the engaging projections 49 project toward and engage the engaging holes 48, respectively.

In the above differential gear mechanism 30, when the planetary carrier 32 does not rotate relative to the driving-side rotator 10, the internal gear 33 does not make the planetary movement and thereby rotates together with the driving-side rotator 10, and thereby each engaging projection 49 urges the inner peripheral wall of the corresponding engaging hole 48 in the rotational direction. As a result, the guide rotator 34 is rotated in the clockwise direction in FIG. 5 while maintaining a relative rotational phase between the guide rotator 34 and the driving-side rotator 10.

When the planetary carrier 32 is rotated relative to the driving-side rotator 10 in the direction X and is thereby advanced due to, for example, an increase in the rotational torque (hereinafter, referred to as a motor torque) generated from the electric motor 21, the internal gear 33 makes the planetary movement while changing its meshed teeth, which are meshed with the external gear 31. Thus, the urging force of each engaging projection 49, which urges the inner peripheral surface of the corresponding engaging hole 48 in the rotational direction, is increased. As a result, the guide rotator 34 is rotated relative to the driving-side rotator 10 in the direction X and is thereby advanced. In contrast, when the planetary carrier 32 is rotated relative to the driving-side rotator 10 in the direction Y and is thereby retarded due to, for example, an increase in the motor torque generated from the electric motor 21, the internal gear 33 makes the planetary movement while changing its meshed teeth, which are meshed with the external gear 31. Thus, each engaging projection 49 urges the inner peripheral surface of the corresponding engaging hole 48 in a counter-rotational direction. As a result, the guide rotator 34 is rotated relative to the driving-side rotator 10 in the direction Y and is thereby retarded.

In the above differential gear mechanism 30, when the motor torque is increased and is transmitted to the guide rotator 34, the guide rotator 34 is driven to rotate relative to the driving-side rotator 10.

Figure 6:
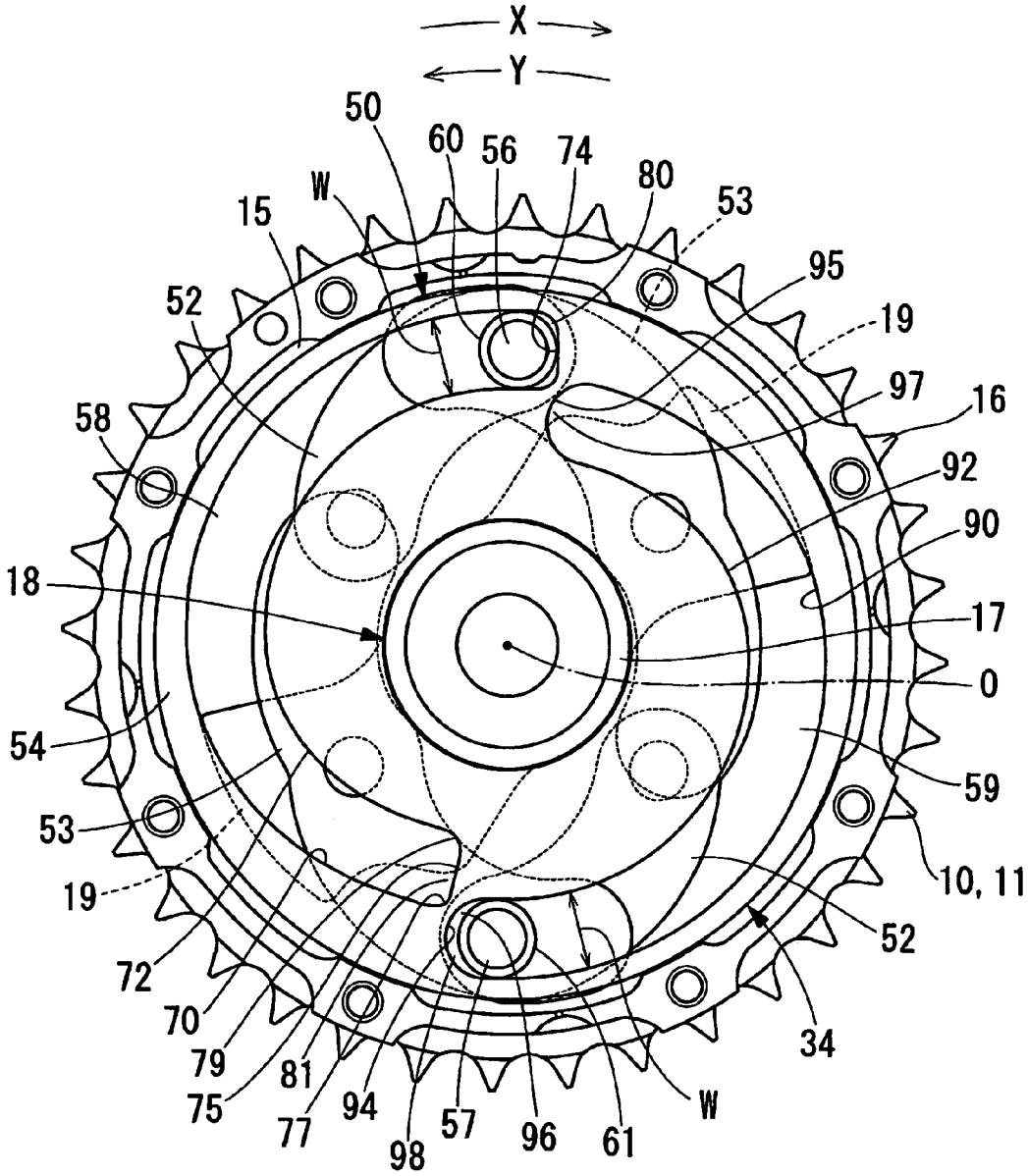
FIG. 6 is a cross sectional view similar to FIG. 4 but showing another operational state.

As shown in FIGS. 2 to 4 and 6, the phase change mechanism 50 includes two link mechanisms 51, a groove forming portion 54 and two movable bodies 56, 57. FIGS. 2 to 4 show one state of the phase change mechanism 50, in which the driven-side rotator 18 is most retarded relative to the driving-side rotator 10. FIG. 6 shows another sate of the phase change mechanism 50, in which the driven-side rotator 18 is most advanced relative to the driving-side rotator 10. In FIGS. 3, 4 and 6, each crosshatching is omitted for the sake of simplicity.

As shown in FIGS. 2 and 3, each link mechanism 51 includes two types of links (first and second links) 52, 53. The link mechanisms 51 are symmetrically arranged with respect to each other in such a manner that the link mechanisms 51 are displaced from each other by 180 degrees about the rotational axis O.

The first link 52 of each link mechanism 51 is formed as an arcuately elongated plate body and is coupled to a predetermined part of the connecting portion 15 by means of a revolute pair. The second link 53 of each link mechanism 51 is formed as an ω (omega) shaped plate body. Furthermore, the second link 53 is coupled to the corresponding coupling portion 19 by means of a revolute pair and is also coupled to the first link 52 of the corresponding link mechanism 51 by means of a revolute pair.

As shown in FIGS. 2 and 4, the groove forming portion 54 is formed in an end surface of the guide rotator 34, which is located on one axial side of the guide rotator 34 opposite from the internal gear 33. In the groove forming portion 54, two guide grooves 58, 59 are formed in such a manner that the guide grooves 58, 59 are rotationally symmetric to each other about the rotational axis O, i.e., are displaced from each other by 180 degrees about the rotational axis O. Each guide groove 58, 59 is positioned on a radially outer side of the rotational axis O and is elongated such that the guide groove 58, 59 has a predetermined width along its length. Also, the guide groove 58, 59 is tilted with respect to a radial direction of the guide rotator 34 in such a manner that a distance from the rotational axis O to the groove 58, 59 changes in a direction of elongation of the groove 58, 59. Specifically, as shown in FIG. 4, the guide groove 58, 59 of the present embodiment is tilted in such a manner that the distance from the rotational axis O to the groove 58, 59 is increased in the direction X. Furthermore, the guide groove 58, 59 of the present embodiment is formed as a blind groove (a bottomed groove) that does not penetrate through the guide rotator 34 except a portion, which is communicated with the engaging hole 48.

As shown in FIGS. 2 to 4, each movable body 56, 57 is formed as a cylindrical shaft body, which is eccentric to the rotational axis O. One end portion of each movable body 56, 57 has two cylindrical members and is slidably fitted into the corresponding groove 58, 59. The other end portion of each movable body 56, 57 is relatively rotatably fitted to the first link 52 of the corresponding link mechanism 51. Furthermore, an intermediate portion of each movable body 56, 57 is securely press fitted to the second link 53 of the corresponding link mechanism 51. Through the above engagement and press fitting, each movable body 56, 57 forms the revolute pair between the link 52 and the link 53.

In the above phase change mechanism 50, when the guide rotator 34 maintains the relative rotational phase between the guide rotator 34 and the driving-side rotator 10, each movable body 56, 57 is not guided in the corresponding guide groove 58, 59 and thereby is rotated together with the guide rotator 34. At this time, in each link mechanism 51, the positional relationship between the links 52, 53 does not change, so that the driven-side rotator 18 is rotated in the clockwise direction in FIGS. 4 and 6 while maintaining the relative rotational phase between the driven-side rotator 18 and the driving-side rotator 10, so that the relative rotational phase of the camshaft 2 relative to the crankshaft is maintained, that is, the valve timing is maintained.

When the guide rotator 34 is rotated relative to the driving-side rotator 10 in the direction X and is thereby advanced, each movable body 56, 57 is guided in the corresponding guide groove 58, 59 toward the rotational axis O. At this time, each movable body 56, 57 is moved in such a manner that the movable body 56, 57 drives and thereby rotates the first link 52 of the corresponding link mechanism 51 and reduces the distance between the movable body 56, 57 and the rotational axis O. As a result, the second link 53 of each link mechanism 51 is pushed by the corresponding movable body 56, 57 in the direction X together with the coupling portion 19. Thus, the driven-side rotator 18 is advanced relative to the driving-side rotator 10, and thereby the valve timing is advanced. In contrast, when the guide rotator 34 is rotated relative to the driving-side rotator 10 in the direction Y and is thereby retarded, each movable body 56, 57 is guided in the corresponding guide groove 58, 59 away from the rotational axis O. At this time, each movable body 56, 57 is moved in such a manner that the movable body 56, 57 drives and thereby rotates the first link 52 of the corresponding link mechanism 51 and increases the distance between the movable body 56, 57 and the rotational axis O. As a result, the second link 53 of each link mechanism 51 is pulled by the corresponding movable body 56, 57 in the direction Y together with the coupling portion 19. Thus, the driven-side rotator 18 is retarded relative to the driving-side rotator 10, and thereby the valve timing is retarded.

As described above, in the phase change mechanism 50, each movable body 56, 57 is guided along the corresponding guide groove 58, 59 in response to the relative rotation of the guide rotator 34 relative to the driving-side rotator 10. In this way, each link mechanism 51 is driven in response to the movement of the corresponding movable body 56, 57, so that the relative rotational phase between the driving-side rotator 10 and the driven-side rotator 18 is changed to change the valve timing.

Next, characteristic features of the movable bodies 56, 57 and the guide grooves 58, 59 of the present embodiment will be described.

Figure 1A:
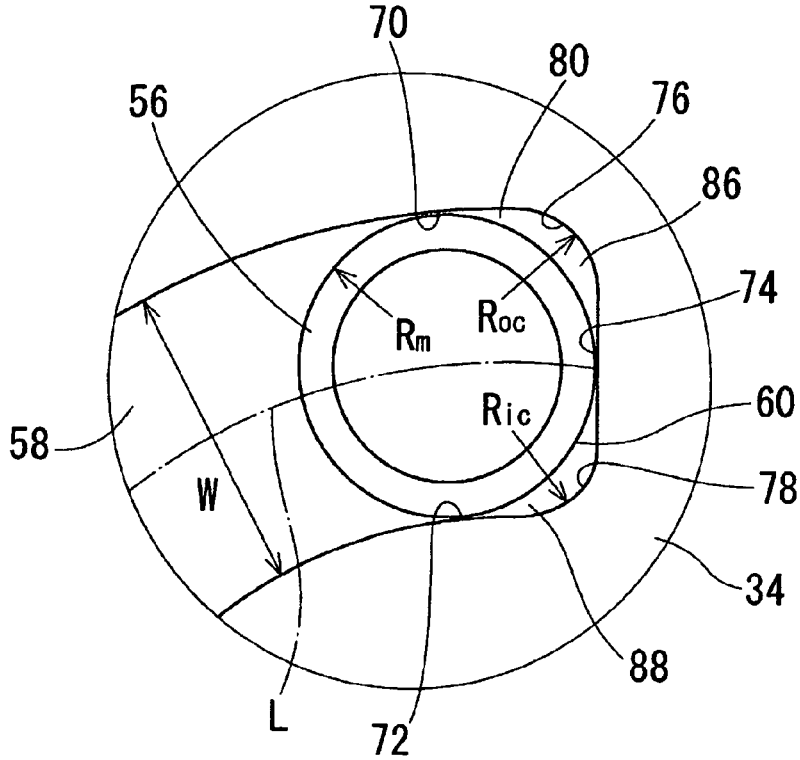
FIG. 1A is an enlarged schematic view showing one state of a movable body received in a guide groove of a valve timing control apparatus according to an embodiment of the present invention.
Figure 1B:
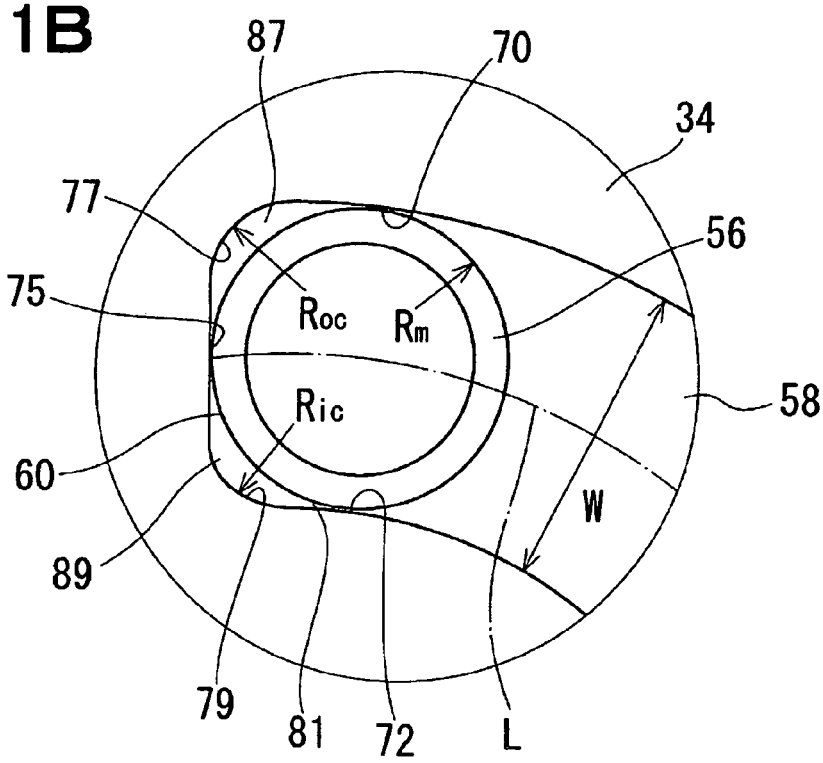
FIG. 1B is an enlarged schematic view showing another state of the movable body received in the guide groove of the valve timing control apparatus according to the embodiment.

As shown in FIGS. 1A, 1B and 4, an outer peripheral surface 60, 61 of the end portion of each movable body 56, 57, which is fitted into the corresponding guide groove 58, 59, is a cylindrical surface, which has an outer diameter that is slightly smaller than the width W of the corresponding guide groove 58, 59. In this way, a sliding clearance 62, which is exaggerated in terms of its scale in FIGS. 7A and 7B for illustrative purpose (in the case of FIGS. 7A and 7B, the sliding clearance 62 is between the movable body 57 and the wall of the guide groove 58), is formed between the movable body 56 and the guide groove 58 and also between the movable body 57 and the guide groove 59.

As shown in FIGS. 4 and 6, the inner peripheral surface of the guide groove 58 includes an outer guide surface 70, an inner guide surface 72, two stopper surfaces 74, 75, two outer connection surfaces 76, 77 and two inner connection surfaces 78, 79.

The outer guide surface 70 and the inner guide surface 72 are opposed to each other in the width direction of the guide groove 58, i.e., in the direction perpendicular to the direction of elongation of the guide groove 58. The outer guide surface 70 is curved such that a distance between the rotational axis O and the outer guide surface 70 changes in the direction of elongation of the guide groove 58. Furthermore, the outer guide surface 70 slidably contacts the outer peripheral surface 60 of the movable body 56 on a radially outer side of the movable body 56 in the radial direction of the guide rotator 34 to guide the movable body 56. The inner guide surface 72 is curved such that a distance between the rotational axis O and the inner guide surface 72 changes in the direction of elongation of the guide groove 58, so that the distance W between the inner guide surface 72 and the outer guide surface 70 is generally constant. Furthermore, the inner guide surface 72 slidably contacts the outer peripheral surface 60 of the movable body 56 on a radially inner side of the movable body 56 in the radial direction of the guide rotator 34 to guide the movable body 56.

The stopper surfaces 74, 75 are provided to opposed ends, respectively, of the guide groove 58, which are opposed to each other in the direction of elongation of the guide groove 58. As shown in FIGS. 1A and 1B, each stopper surface 74, 75 is planar in a direction generally perpendicular to an axis L of the direction of elongation of the guide groove 58. As shown in FIG. 1A, when the movable body 56 reaches the end portion 80 of the guide groove 58, the stopper surface 74 contacts the outer peripheral surface 60 of the movable body 56 on an outer side of the movable body 56 in the direction of elongation of the guide groove 58 to stop the movable body 56. In contrast, as shown in FIG. 1B, when the movable body 56 reaches the other end portion 81 of the guide groove 58, the stopper surface 75 contacts the outer peripheral surface 60 of the movable body 56 on an outer side of the movable body 56 in the direction of elongation of the guide groove 58 to stop the movable body 56.

As shown in FIGS. 4 and 6, the outer connection surfaces 76, 77 are provided to the end portions 80, 81, respectively, of the guide groove 58. Each outer connection surface 76, 77 is an arcuate surface, which connects between the corresponding stopper surface 74, 75 and the outer guide surface 70 at the corresponding end portion 80, 81. As shown in FIGS. 1A and 1B, a radius of curvature Roc of each outer connection surface 76, 77 is smaller than a radius of curvature Rm of the outer peripheral surface 60 of the movable body 56.

As shown in FIGS. 4 and 6, the inner connection surfaces 78, 79 are provided to the end portions 80, 81, respectively, of the guide groove 58. Each inner connection surface 78, 79 is an arcuate surface, which connects between the corresponding stopper surface 74, 75 and the inner guide surface 72 at the corresponding end portion 80, 81. As shown in FIGS. 1A and 1B, a radius of curvature Ric of each inner connection surface 78, 79 is smaller than a radius of curvature Rm of the outer peripheral surface 60 of the movable body 56.

Furthermore, the radius of curvature Ric of each inner connection surface 78, 79 is generally the same as the radius curvature Roc of the outer connection surface 76, 77. Alternatively, the radius of curvature Ric of each inner connection surface 78, 79 may differ from the radius of curvature Roc of the outer connection surface 76, 77.

As shown in FIGS. 4 and 6, an inner peripheral surface of the guide groove 59 includes an outer guide surface 90, an inner guide surface 92 and two connection surfaces 94, 95.

The outer guide surface 90 is similar to the outer guide surface 70 of the guide groove 58 except that the outer guide surface 90 guides the movable body 57 through the slidable contact with the outer peripheral surface 61 of the movable body 57. Also, the inner guide surface 92 is similar to the inner guide surface 72 of the guide groove 58 except that the inner guide surface 92 guides the movable body 57 through the slidable contact with the outer peripheral surface 61 of the movable body 57. The connection surfaces 94, 95 are provided to the end portions 96, 97, respectively, of the guide groove 59 to connect between the outer guide surface 90 and the inner guide surface 92. As shown in FIG. 4, when the stopper surface 74 of the guide groove 58 stops the movable body 56, the connection surface 94 does not contact the outer peripheral surface 61 of the removable body 57 and forms a space 98 between the connection surface 94 and the outer peripheral surface 61 of the movable body 57. Furthermore, as shown in FIG. 6, when the stopper surface 75 of the guide groove 58 stops the movable body 56, the connection surface 95 does not contact the outer peripheral surface 61 of the movable body 57 and forms a space 99 between the connection surface 95 and the outer peripheral surface 61 of the movable body 57.

Next, the characteristic operation of the present embodiment will be described.

When the movable body 56 reaches the end portion 80 of the guide groove 58 upon driving of the guide rotator 34 in the direction Y caused by generation of the motor torque in the direction Y, the stopper surface 74 contacts the outer peripheral surface 60 of the movable body 56 while the connection surfaces 76, 78, each of which has the radius of curvature smaller than the radius of curvature the outer peripheral surface 60 of the movable body 56, do not contact the outer peripheral surface 60 of the movable body 56. At this time, the stopper surface 74 contacts the outer peripheral surface 60 of the movable body 56 in the direction generally perpendicular to the axis L of the direction of elongation of the guide groove 58 on the outer side of the movable body 56 in the direction of elongation of the guide groove 58. Thus, the movable body 56 is stopped by the stopper surface 74 while limiting tilting of the movable body 56, and therefore the relative rotation of the guide rotator 34 relative to the driving-side rotator 10 is forcefully stopped. Furthermore, when the movable body 56 is stopped by the stopper surface 74, the movement of the link mechanism 51, which is coupled with the movable body 56, is also stopped. Thus, the relative rotational phase of the driven-side rotator 18 relative to the driving-side rotator 10 is limited to the most retarded phase shown in FIG. 4.

Figure 8:
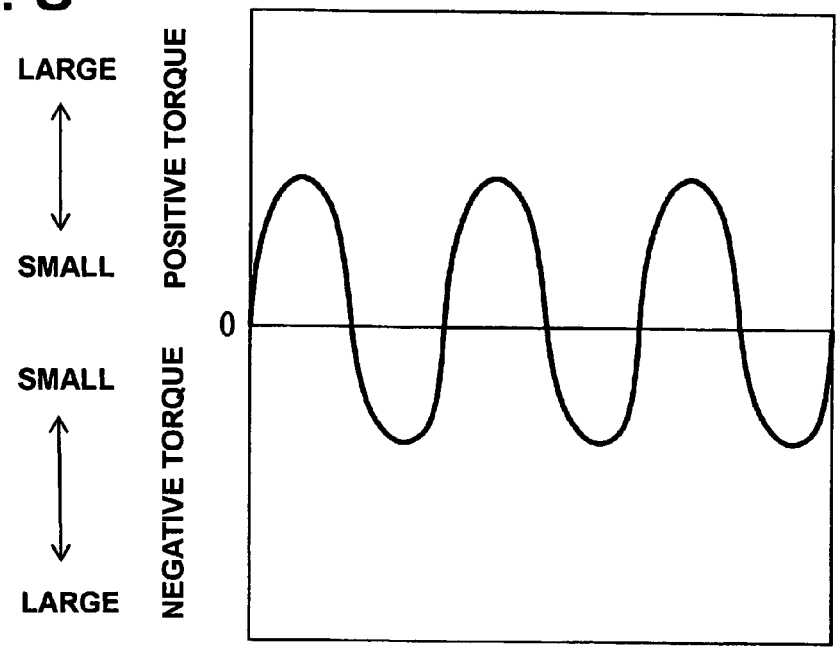
FIG. 8 is a diagram illustrating a fluctuating torque.
Figure 7A:
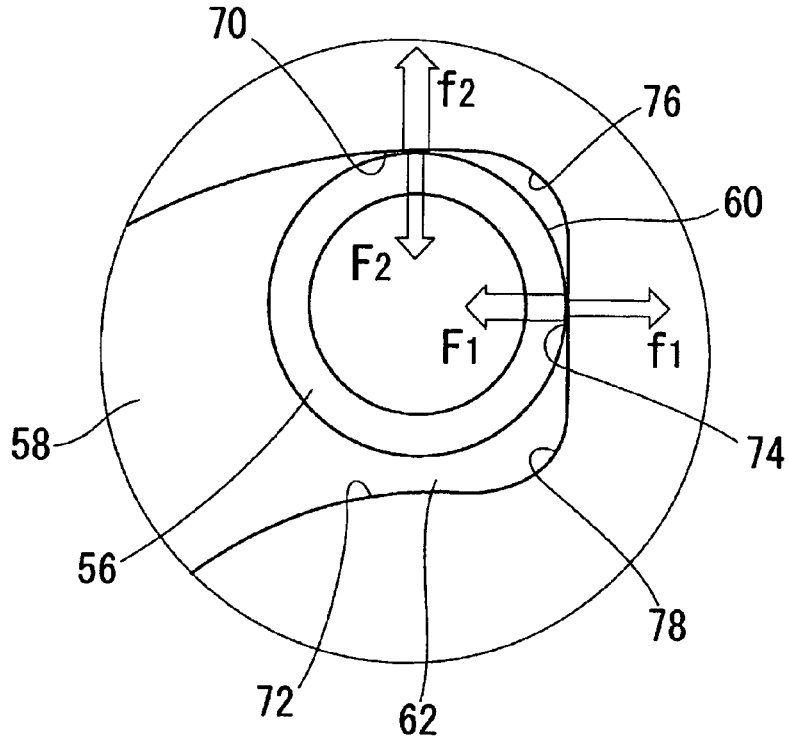
FIG. 7A is an exaggerated illustrative view for describing characteristics of the valve timing control apparatus of FIG. 2.

During the operation of the internal combustion engine, a positive torque and a negative torque are alternately transmitted from the camshaft 2 to the driven-side rotator 18, as shown in FIG. 8. Here, the positive torque is a torque, which acts in the retarding direction for retarding the driven-side rotator 18 relative to the driving-side rotator 10 at the time of depressing the intake valve. Furthermore, the negative torque is a torque, which acts in the advancing direction for advancing the driven-side rotator 18 relative to the driving-side rotator 10 at the time of returning the intake valve. As described above, when the positive torque acts on the driven-side rotator 18 at the time of engagement of the movable body 56 to the stopper surface 74, each link mechanism 51 tries to move the corresponding movable body 56, 57 away from the rotational axis O. Therefore, as shown in FIG. 7A, the outer peripheral surface 60 of the movable body 56, which has the diameter smaller than the width of the guide groove 58, contacts both of the stopper surface 74 and the outer guide surface 70. Specifically, the outer peripheral surface 60 of the movable body 56 makes the two-point contact with the inner peripheral surface of the guide groove 58. Thus, the movable body 56 receives a force F1, which is applied from the guide groove 58 due to the motor torque, and a reaction force F2, which is generated at the time of pressing the guide groove 58 from the movable body 56 caused by the positive torque. These forces F1 and F2 are applied to the movable body 56 at the two different points, respectively. At the same time, the guide groove 58 receives a reaction force f1, which is generated at the time of pushing the movable body 56 from the guide groove 58, and a force f2, which is applied from the movable body 56 due to the positive torque.

Figure 7B:
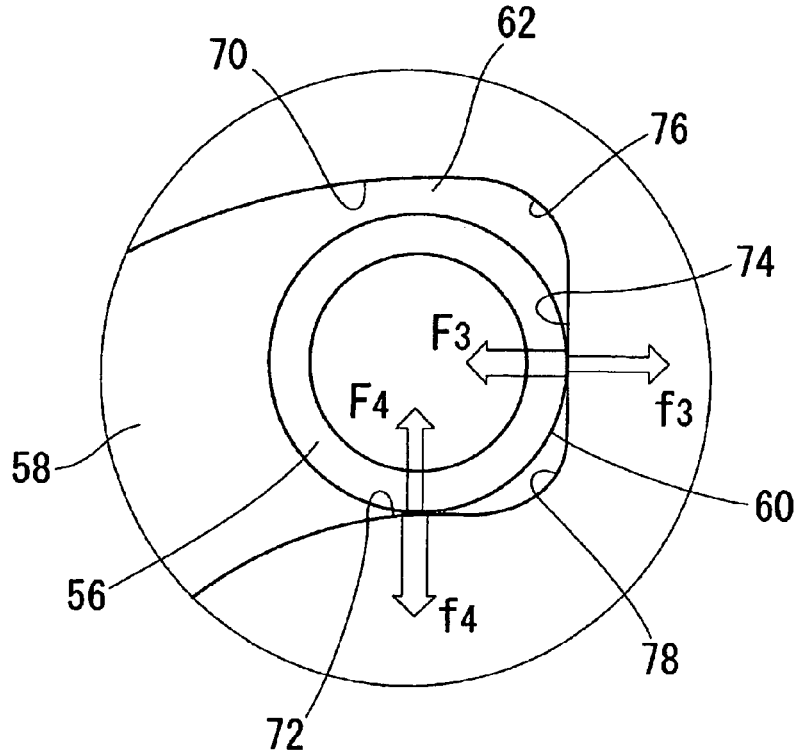
FIG. 7B is anther exaggerated illustrative view for describing characteristics of the valve timing control apparatus of FIG. 2.

Furthermore, when the negative torque acts on the driven-side rotator 18 at the time of engagement of the movable body 56 to the stopper surface 74, each link mechanism 51 tries to move the corresponding movable body 56, 57 toward the rotational axis O. Therefore, as shown in FIG. 7B, the outer peripheral surface 60 of the movable body 56, which has the diameter smaller than the width of the guide groove 58, contacts both of the stopper surface 74 and the inner guide surface 72. Specifically, the outer peripheral surface 60 of the movable body 56 makes the two-point contact with the inner peripheral surface of the guide groove 58. Thus, the movable body 56 receives a force F3, which is applied from the guide groove 58 due to the motor torque, and a reaction force F4, which is generated at the time of pressing the guide groove 58 from the movable body 56 caused by the negative torque. These forces F3 and F4 are applied to the movable body 56 at the two different points, respectively. At the same time, the guide groove 58 receives a reaction force f3, which is generated at the time of pushing the movable body 56 from the guide groove 58, and a force f4, which is applied from the movable body 56 due to the negative torque.

When the movable body 56 reaches the end portion 81 of the guide groove 58 upon driving of the guide rotator 34 in the direction X caused by generation of the motor torque in the direction X, the stopper surface 75 contacts the outer peripheral surface 60 of the movable body 56 while the connection surfaces 76, 78, each of which has the radius of curvature smaller than the radius of curvature of the outer peripheral surface 60 of the movable body 56, do not contact the outer peripheral surface 60 of the movable body 56. Thus, similar to the above case where the motor torque is generated in the direction Y, the movable body 56 is stopped by the stopper surface 75 while limiting the tilting of the movable body 56. Thus, the relative rotational phase of the driven-side rotator 18 relative to the driving-side rotator 10 is limited to the most advanced phase. Furthermore, even when the fluctuating torque (the positive and negative torques) is applied to the driven-side rotator 18 at the time of engagement of the movable body 56 to the stopper surface 75 caused by the motor torque in the direction X, the point of application of the force, which is caused by the motor torque, is separated from the point of application of the force, which is caused by the fluctuating torque, like in the above case where the motor torque is generated in the direction Y.

According to the present embodiment described above, when the relative rotational phase between the driving-side rotator 10 and the driven-side rotator 18 is limited through the engagement between the movable body 56 and the stopper surface 74, 75, the tilting of the movable body 56 is limited. Thus, it is possible to limit occurrence of the sticking, i.e., arresting of the movable body 56 in the guide groove 58, which likely cause a failure or a damage. Furthermore, according to the present embodiment, even when the fluctuating torque is applied to the driven-side rotator 18 at the time of engagement of the movable body 56 to the stopper surface 74, 75 caused by the motor torque, the point of application of the force, which is caused by the motor torque, is separated from the point of application of the force, which is caused by fluctuating torque. Thus, the surface pressure applied to each of these points is reduced. Therefore, it is possible to limit deformation or malfunctioning of the movable body 56 and/or the guide groove 58, which would be otherwise caused by the surface pressure between the movable body 56 and the guide groove 58.

Furthermore, according to the present embodiment, as shown in FIG. 1A, each space 86, 88 is formed between the outer peripheral surface 60 of the movable body 56, which is reached to the end portion 80 of the guide groove 58, and the corresponding connection surface 76, 78, which does not contact the outer peripheral surface 60 of the movable body 56. Therefore, even when a foreign object (e.g., foreign debris), which enters the guide groove 58, is carried to the end portion 80 by the movable body 56, it is possible to evacuate or place the foreign object into the space 86, 88. Furthermore, as shown in FIG. 1B, each space 87, 89 is formed between the outer peripheral surface 60 of the movable body 56, which is reached to the end portion 81 of the guide groove 58, and the corresponding connection surface 77, 79, which does not contact the outer peripheral surface 60 of the movable body 56. Therefore, even when the foreign object, which enters the guide groove 58, is carried to the end portion 81 by the movable body 56, it is possible to evacuate or place the foreign object into the space 87, 89. Therefore, according to the present embodiment, it is possible to limit the malfunctioning, which would be caused by the intrusion of the foreign object into the guide groove 58.

Furthermore, according to the present embodiment, the fluctuating torque, which is transmitted to the driven-side rotator 18, is reduced by conducting it through the respective link mechanisms 51 and becomes the force for driving the respective movable bodies 56, 57 toward or away from the rotational axis O. Each movable body 56, 57 collides against the corresponding outer guide surface 70, 90 or the corresponding inner guide surface 72, 92 due to the above-described forces. However, the collision sound or noise, which is generated at the time of colliding of the movable body 56, 57, is smaller in comparison to the case of Japanese Unexamined Patent Publication No. 2005-48707 where the rotator, which receives the fluctuating torque, abuts against the stopper. Therefore, according to the present embodiment, it is possible to limit generation of the noisy sound.

In the above embodiment, the driving-side rotator 10 serves as a first rotator of the present embodiment, and the driven-side rotator 18 serves as a second rotator of the present embodiment. Furthermore, the control unit 20 and the differential gear mechanism 30 cooperate together to serves as a drive means of the present invention.

The present invention is not limited to the above embodiment, and the above embodiment may be modified in various ways without departing from the scope of the present invention.

For instance, the surfaces 74, 76, 78 of the guide groove 58 may be changed to the connection surface 94 of the guide groove 59, or the connection surface 94 of the guide groove 59 may be changed to the surfaces 74, 76, 78 of the guide groove 58. Also, the surfaces 75, 77, 79 of the guide groove 58 may be changed to the connection surface 95 of the guide groove 59, or the connection surface 95 of the guide groove 59 may be changed to the surfaces 75, 77, 79 of the guide groove 58.

Furthermore, unlike the above embodiment, each guide groove 58, 59 may be tilted such that the distance from the rotational axis O to the guide groove 58, 59 increases in the direction Y. In such a case, when the guide rotator 34 is rotated relative to the driving-side rotator 10 in the direction X and is thereby advanced, each movable body 56, 57 is guided in the corresponding guide groove 58, 59 away from the rotational axis O, so that the driven-side rotator 18 is retarded relative to the driving-side rotator 10. Furthermore, in such a case, when the guide rotator 34 is rotated relative to the driving-side rotator 10 in the direction Y and is thereby retarded, each movable body 56, 57 is guided in the corresponding guide groove 58, 59 toward the rotational axis O, so that the driven-side rotator 18 is retarded relative to the driving-side rotator 10.

Furthermore, each guide groove 58, 59 is not need to be curved like in the above embodiment. For example, the guide groove 58, 59 may be formed as a linear guide groove. Also, the guide groove 58, 59 may or may not penetrate through the guide rotator 34.

Furthermore, unlike the above embodiment, the rotator 10 may be rotated synchronously with the camshaft 2, and the rotator 18 may be rotated synchronously with the crankshaft.

Figure 9:
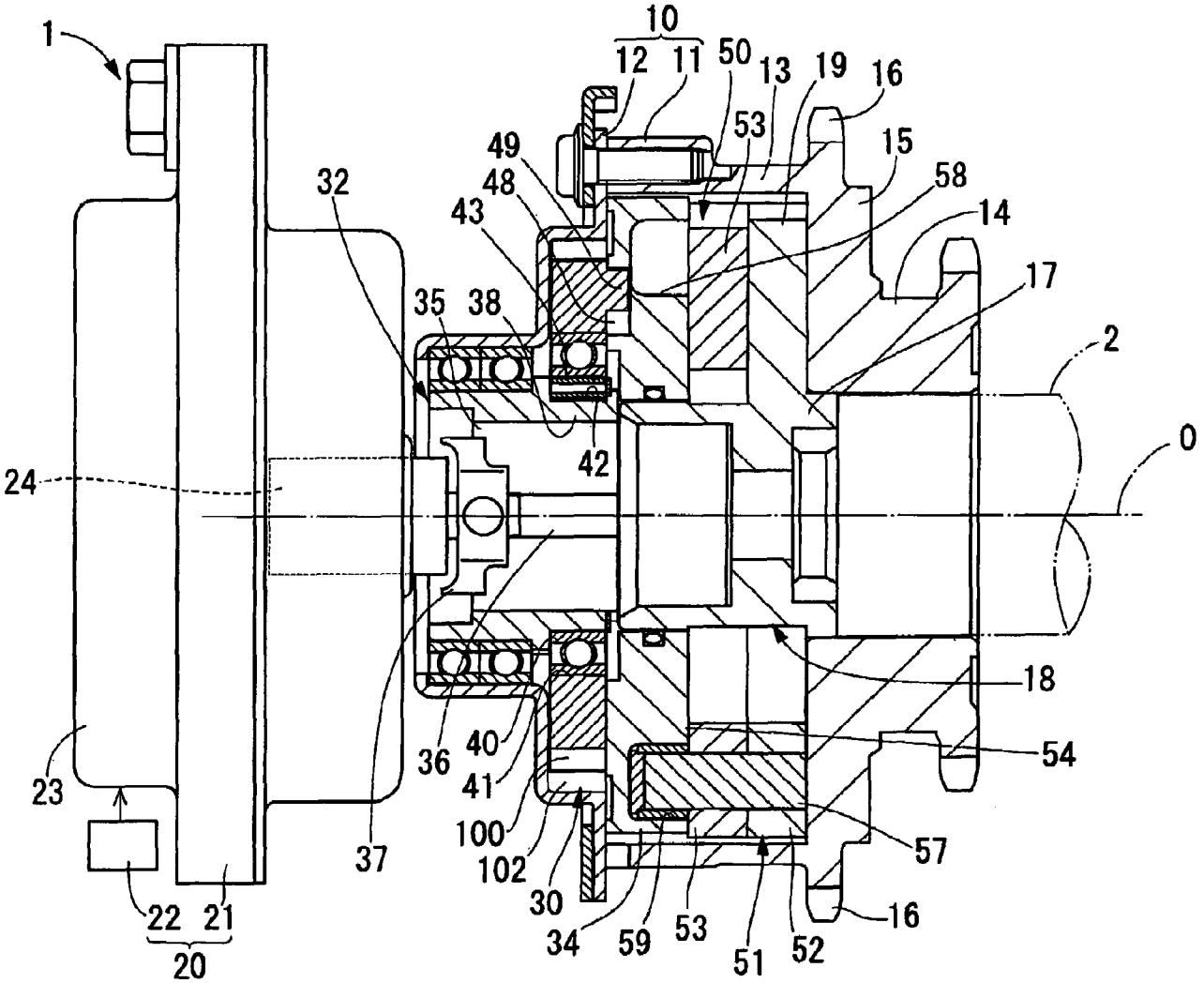
FIG. 9 is a cross sectional view showing a modification of the valve timing control apparatus shown in FIG. 2.

In addition, as shown in FIG. 9, in place of the internal gear 33 of the above embodiment, an external gear 100, which has the engaging projections 49 and is supported by the planetary carrier 32, may be provided. Furthermore, in place of the external gear 31 of the above embodiment, an internal gear 102, which is meshed with the external gear 100, may be provided to the rotator 10.

Also, in place of the electric motor 21 of the above embodiment, any other appropriate drive apparatus may be provided. For instance, a solenoid brake apparatus, which has a brake member and a solenoid, may be provided. The brake member is rotated when the drive torque of the crankshaft is transmitted to the brake member. The solenoid magnetically attracts the brake member. A braking torque, which is generated in the brake member attracted to the solenoid, is exerted as the rotational torque. Furthermore, in place of the electric motor 21, a hydraulic motor may be provided.

Furthermore, the present invention is not limited to the apparatus, which controls, i.e., adjusts the valve timing of the intake valve(s). For instance, the present invention may be equally implemented in an apparatus, which controls, i.e., adjusts valve timing of an exhaust valve(s). Also, the present invention may be implemented in an apparatus, which controls, i.e., adjusts both of the valve timing of the intake valve(s) and the valve timing of the exhaust valve(s).

Additional advantages and modifications will readily occur to those skilled in the art. The invention in its broader terms is therefore not limited to the specific details, representative apparatus, and illustrative examples shown and described.

What is claimed is:

1. A valve timing control apparatus of an internal combustion engine, which controls valve timing of at least one of an intake valve and an exhaust valve that are opened and closed by a camshaft driven by a torque transmitted from a crankshaft, the valve timing control apparatus comprising:

a first rotator that is rotated synchronously with the crankshaft;

a second rotator that is rotated synchronously with the camshaft;

a guide rotator that has a guide groove, which is elongated and has a predetermined width;

a movable body that is guided in the guide groove in a direction of elongation of the guide groove to move toward or away from a rotational axis of the guide rotator in response to rotation of the guide rotator; and a link mechanism that is coupled with the first rotator, the second rotator and the movable body to change a relative rotational phase between the first rotator and the second rotator in response to movement of the movable body, wherein:

the movable body has a cylindrical outer peripheral surface; and the guide groove includes:

a stopper surface that is planar and is positioned in one of two opposed ends of the guide groove, which are opposed to each other in the direction of elongation of the guide groove, wherein the stopper surface is engageable with the cylindrical outer peripheral surface of the movable body in the direction of elongation of the guide groove to stop the movable body;

an outer guide surface that is slidably engageable with the cylindrical outer peripheral surface of the movable body to guide the movable body and that is positioned on a radially outer side of the movable body in a radial direction of the guide rotator;

an arcuate outer connection surface that connects between the stopper surface and the outer guide surface and has a radius of curvature, which is smaller than that of the cylindrical outer peripheral surface of the movable body;

an inner guide surface that is slidably engageable with the cylindrical outer peripheral surface of the movable body to guide the movable body and that is positioned on a radially inner side of the movable body in the radial direction of the guide rotator; and an arcuate inner connection surface that connects between the stopper surface and the inner guide surface and has a radius of curvature, which is smaller than that of the cylindrical outer peripheral surface of the movable body.

2. The valve timing control apparatus according to claim 1, further comprising a drive means for driving the guide rotator to rotate the guide rotator by providing a rotational torque to the guide rotator, wherein:

an outer diameter of the cylindrical outer peripheral surface of the movable body is smaller than the width of the guide groove;

when the movable body is moved toward the rotational axis of the guide rotator, the link mechanism causes relative rotation of the second rotator relative to the first rotator in one of an advancing direction and a retarding direction; and when the movable body is moved away from the rotational axis of the guide rotator, the link mechanism causes relative rotation of the second rotator relative to the first rotator in the other one of the advancing direction and the retarding direction.

3. The valve timing control apparatus according to claim 2, wherein:

the stopper surface of the guide groove is a first stopper surface of the guide groove;

the arcuate outer connection surface of the guide groove is a first arcuate outer connection surface of the guide groove;

the arcuate inner connection surface of the guide groove is a first arcuate inner connection surface of the guide groove; and the guide groove further includes:

a second stopper surface that is planar and is positioned in the other one of the two opposed ends of the guide groove, wherein the second stopper surface is engageable with the cylindrical outer peripheral surface of the movable body in the direction of elongation of the guide groove to stop the movable body;

a second arcuate outer connection surface that connects between the second stopper surface and the outer guide surface and has a radius of curvature, which is smaller than that of the cylindrical outer peripheral surface of the movable body; and a second arcuate inner connection surface that connects between the second stopper surface and the inner guide surface and has a radius of curvature, which is smaller than that of the cylindrical outer peripheral surface of the movable body.

4. The valve timing control apparatus according to claim 2, wherein:

the drive means includes an electric motor, which generates the rotational torque; and the drive means transmits the rotational torque, which is generated by the electric motor, to the guide rotor.

* * * * *